US009945622B2

(12) United States Patent
Byrne

(10) Patent No.: US 9,945,622 B2
(45) Date of Patent: Apr. 17, 2018

(54) DOUBLE-WALLED DRY HEAT EXCHANGER COIL WITH SINGLE-WALLED RETURN BENDS

(71) Applicant: Evapco, Inc., Taneytown, MD (US)

(72) Inventor: Tom Byrne, Aalborg (DK)

(73) Assignee: Evapco, Inc., Taneytown, MD (US)

( * ) Notice: Subject to any disclaimer, the term of this patent is extended or adjusted under 35 U.S.C. 154(b) by 547 days.

(21) Appl. No.: 13/870,205

(22) Filed: Apr. 25, 2013

(65) Prior Publication Data

US 2014/0138050 A1 May 22, 2014

Related U.S. Application Data

(60) Provisional application No. 61/638,275, filed on Apr. 25, 2012.

(51) Int. Cl.

| | |
|---|---|
| ***B60H 1/00*** | (2006.01) |
| ***F28F 17/00*** | (2006.01) |
| ***F28D 7/16*** | (2006.01) |
| ***F28F 1/00*** | (2006.01) |
| ***F28D 7/08*** | (2006.01) |
| *F28D 15/00* | (2006.01) |

(52) U.S. Cl.
CPC ..... *F28F 17/005* (2013.01); *F28D 7/085* (2013.01); *F28D 7/1623* (2013.01); *F28F 1/003* (2013.01); *F28D 15/00* (2013.01)

(58) Field of Classification Search
CPC ..... F28F 1/003; F28F 2265/22; F28F 2265/06
See application file for complete search history.

(56) References Cited

U.S. PATENT DOCUMENTS 1,430,769 A * 10/1922 Thompson ..... 165/162
2,187,555 A * 1/1940 Flindt ..... F28D 7/1661 138/114

(Continued)

FOREIGN PATENT DOCUMENTS

DE 19608049 9/1997
DE 19721111 11/1997

(Continued)

OTHER PUBLICATIONS

JPH0878242 machine translation.*

(Continued)

*Primary Examiner* — Len Tran
*Assistant Examiner* — Gordon Jones
(74) *Attorney, Agent, or Firm* — Whiteford, Taylor & Preston, LLP; Peter J. Davis

(57) ABSTRACT

A dry heat exchanger coil having a plurality of straight inner tubes connected by a plurality of return bends. The return bends are located outside of the air flow passing over the coil. The inner tubes are situated within a corresponding outer or "safety" tube. The outer tubes do not contain and are not connected to return bends, but the ends of the outer tubes are located outside of the air flow path. Leaks in the inner tubes are captured by the outer tubes and the leaking fluid will flow in the space between the inner and outer tubes, flow out the end of the outer tube, to be captured in a drip pan at the bottom of the coil housing. Leaks occurring in the return bends will also be captured in drip pan.

7 Claims, 6 Drawing Sheets

(56) References Cited

U.S. PATENT DOCUMENTS

| | | | | | |
|---|---|---|---|---|---|
| 2,545,280 | A | * | 3/1951 | Buchert | C12C 7/26 138/114 |
| 2,858,677 | A | | 11/1958 | Stone | |
| 3,467,178 | A | | 9/1969 | Ware | |
| 3,878,593 | A | | 4/1975 | Owen | |
| 3,948,315 | A | * | 4/1976 | Powell | F28D 7/06 165/143 |
| 4,210,199 | A | | 7/1980 | Doucette et al. | |
| 4,232,735 | A | | 11/1980 | Kim et al. | |
| 4,313,491 | A | * | 2/1982 | Molitor | F28D 7/024 165/160 |
| 4,326,582 | A | * | 4/1982 | Rosman | F28D 7/026 165/143 |
| 4,558,734 | A | * | 12/1985 | Wolfseder | F28B 9/08 165/113 |
| 4,635,711 | A | * | 1/1987 | Clark, Jr. | F28D 7/06 165/158 |
| 5,211,221 | A | * | 5/1993 | Lease | F28F 9/162 156/294 |
| 5,551,507 | A | | 9/1996 | Vogel | |
| 7,011,143 | B2 | | 3/2006 | Corrado et al. | |
| 2008/0314378 | A1 | * | 12/2008 | Khan et al. | 126/99 R |
| 2010/0126704 | A1 | | 5/2010 | Sinha | |
| 2012/0092109 | A1 | * | 4/2012 | Chartouni et al. | 336/55 |
| 2014/0262188 | A1 | * | 9/2014 | Sistla | F28F 17/005 165/182 |

FOREIGN PATENT DOCUMENTS

| | | | | |
|---|---|---|---|---|
| JP | H0878242 | * | 3/1966 | G08B 21/00 |
| JP | 58139413 | | 8/1983 | |

OTHER PUBLICATIONS

International Search Report dated Jul. 30, 2013 in corresponding International Application No. PCT/US2013/038177.

Extended European Search Report issued in corresponding European Application No. 13782020.5 dated Dec. 21, 2015.

* cited by examiner

DOUBLE-WALLED DRY HEAT EXCHANGER COIL WITH SINGLE-WALLED RETURN BENDS

This application claims priority from U.S. Provisional Application No. 61/638,275, the disclosure of which is incorporated herein in its entirety.

FIELD OF THE INVENTION

The present invention relates to non-evaporative or "dry" heat exchangers, particularly those used to cool marine power transformers, although the invention can be used in any environment or situation where "dry" cooling solutions are required or desired.

BACKGROUND OF THE INVENTION

According to the prior art, the air used for cooling a transformer is passed over a series of coils through which water is circulated. The prior art dry transformer cooling coils consist of a series of straight double-walled tubes which terminate at each end in sealed chambered headers. The inner tubes of the straight tubes terminate in one chamber of the header, and the outer tubes terminate in a separate sealed chamber of the header. Cooling fluid is circulated through the inner tubes, and through the corresponding chambers of the headers at each end. Air is passed only over the tubes, and the chambered headers are located outside of the air stream. Any leak in one of the inner tubes is captured by its corresponding outer tube and travels to the separate header chamber at which the outer tubes terminate. Thus, any water from leaks in the inner tubes finds its way to an outer tube chamber in one of the headers. A leak detector is present at the bottom of each of the outer tube chambers to detect the presence of any water. The headers are sealed from one another and from the outside with gaskets, but can be opened for inspection. The disadvantages of this system include the material cost and complex construction of the chambered headers, with outer tubes terminating in one chamber and inner tubes terminating in another chamber. In addition, the chambered headers restrict the ability to efficiently circuit the coil.

SUMMARY OF THE INVENTION

The present invention provides an elegant, safe and cost effective alternative to the prior art.

While not intended to limit the scope of the invention, the description of the invention herein is presented in the context of a dry cooling solution for marine and other "dry" applications where the need to prevent water contact or contamination is critical. In particular, the present invention is particularly well-suited for use in a cooling unit used to cool transformers on ships. A "dry" cooling solution is required for marine transformers because if water contact causes a ship or other marine transformer to short circuit and fail, the ship can be left stranded without power. Therefore, marine transformer cooling systems are required to be "failsafe" systems that do not expose water to the transformer and which provide for the isolation and detection of any potential leaks in the system.

Therefore, there is presented according to an embodiment of the invention, a non-evaporative heat exchanger coil having a plurality of straight inner tubes connected by a plurality of return bends. The return bends allow fluid to move back and forth through the straight inner tubes of the coil. The return bends are preferably located outside of the air flow passing over the coil. The straight lengths of the inner tubes are each situated within a corresponding outer or "safety" tube. The outer tubes preferably terminate at or before the return bends that connect the inner tubes to one-another, but in any event, the ends of the outer tubes are located outside of the air flow path. Thus, the straight lengths of the heat exchange coil are double-walled or doubled tubed (inner tube within an outer tube), but the return bends are single-walled or single tubed. According to an embodiment of the invention, the inner surfaces of the outer tubes are dimpled, grooved, ribbed, or otherwise patterned to create both contact points and voids between the inner and outer tubes. Leaks occurring in the straight inner tubes are captured by the outer tubes and the leaking fluid will flow in the space between the inner and outer tubes, drip or flow out the end of the outer tube, outside of the air flow path, to be captured in a drip pan or leak detector box at the bottom of the coil housing. According to an embodiment of the invention, leaks occurring in the return bends will also be captured in drip pan or leak detector box. The bottom of the coil housing may be sloped so that only one leak detector is required.

According to an embodiment of the invention, capturing leaks outside of the airstream allows a dry transformer to continue operating, notwithstanding the existence of a leak. In the case of a marine transformer on a ship, this embodiment allows a ship to continue operating long enough to return to port for repair.

According to an embodiment of the invention, no chambered headers are used, and neither the return bends nor the ends of the outer tubes need be contained in special water-tight housings.

According to an embodiment of the invention, connecting the inner tubes using return bends, thereby avoiding chambered headers, allows for more flexibility in coil circuit design.

According to an embodiment of the invention, the return bends of the inner tubes are located outside of and separated from the air flow path over the coil.

According to an embodiment of the invention, the ends of the outer tubes are located outside of and separated from the air flow path over the coil.

According to an embodiment, the return bends and the ends of the outer tubes are located in a return bend box or other portion of the housing that is set off, but attached to, the primary housing. According to an embodiment of the invention, the return bend box need not be water-tight.

According to an embodiment of the invention, fluid may also be introduced to and returned from the coil at one of the return bend boxes. The leak detectors may be located at the bottom of the return bend boxes. According to a further embodiment of the invention, a sloping drain pan may be provided at the bottom of the coil so that water collected from leaks at one side of the coil drains to the other side of the coil for detection using a single leak detector. Preferably, when a leak is detected, the transformer may be turned off, either automatically or manually, so the leak can be repaired.

According to an embodiment of the invention, the space between the outer tubes and the inner tubes may be sealed or otherwise closed at one end of the coil, so that any leak in the inner tubes comes out only in the return bend box at the opposite end of the coil. According to a preferred embodiment, the space between the inner and outer tubes remains open at the header end of the coil, and is sealed at the opposite end of the coil, so that water from leaks in the inner tubes travels down the inside of the outer tubes and into the return bend box at the header end, where it is detected by a leak detector. According to this embodiment, there is no need for a sloping drain pan.

According to an embodiment of the invention, the coils may be situated in the bottom portion of a housing or "box" which is attached to a transformer transfer box. Fans located in the top portion of the housing draw air from the transfer box and force it down over the coils where it is cooled, and the cooled air then exits the housing and returns to the transfer box. Heat transfer is facilitated with the use of fins fixed to the outside surfaces of the outer/safety tubes.

According to the invention, the coils can be an open system, in which water is drawn from a source, circulated through the coils and returned to the source, or a closed system in which the same water is circulated through the coils. In the case of a closed system, the water warmed by the air passing over them will be cooled in a separate system before returning to the coils of the present invention.

While the present invention is described in the context of a heat exchanger in which water is used to cool air that in turn is used to cool a power transformer, the invention is equally suited to other types of heat exchange. For example, persons of ordinary skill in the art would readily recognize that the invention can be equally used to effect heat exchange in reverse, whereby air passing over the coils can be used to receive heat from a process/industrial fluid contained in the coil, thereby cooling the process fluid.

DESCRIPTION OF THE DRAWINGS

The subsequent description of the preferred embodiments of the present invention refers to the attached drawings, wherein.

DETAILED DESCRIPTION OF THE INVENTION

In the following description, numerous details are set forth to provide a more thorough explanation of the present invention. It will be apparent, however, to one skilled in the art, that the present invention may be practiced without these specific details.

Figure 1A:
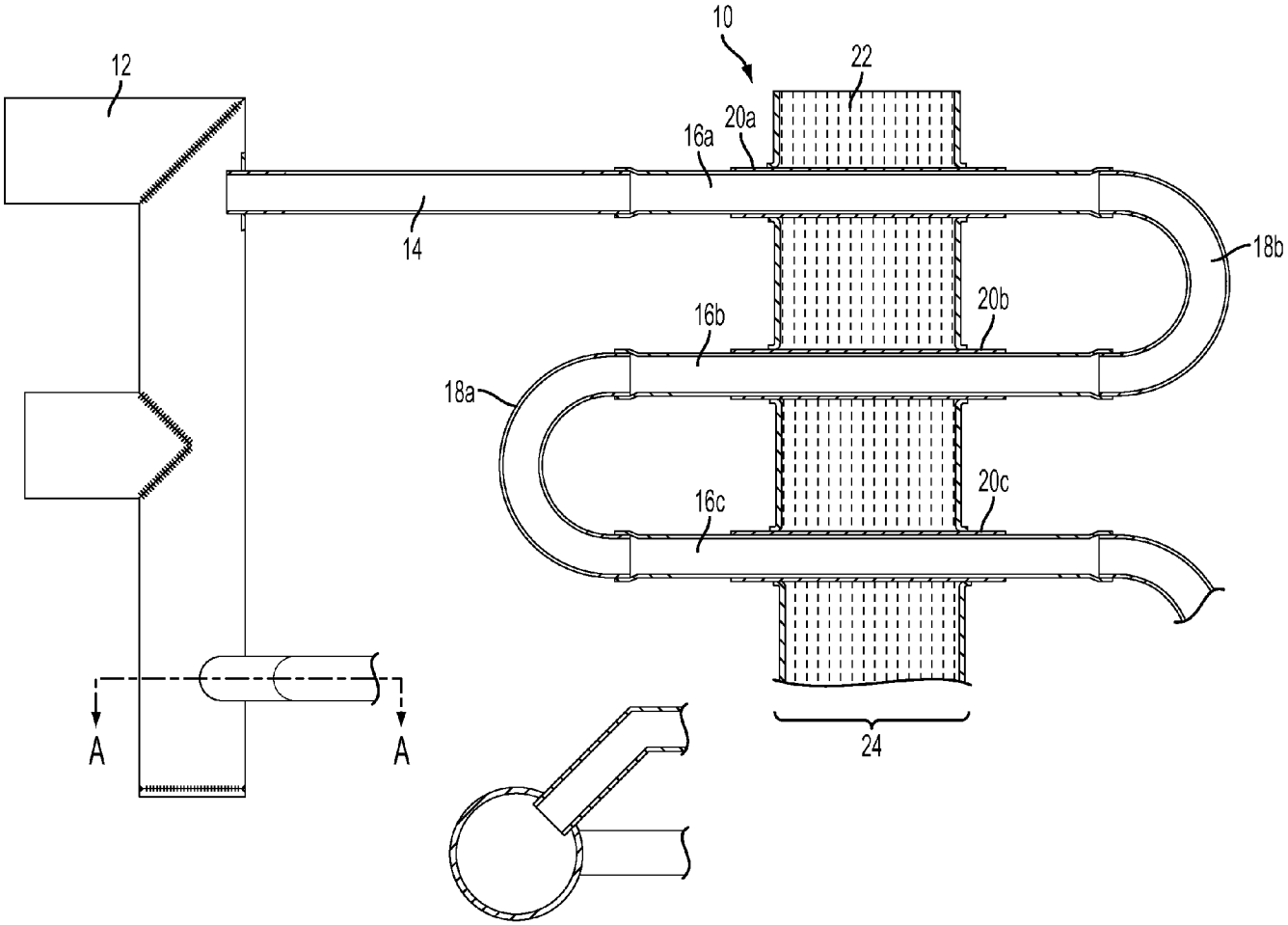
FIG. 1A is a schematic of a section of heat exchange coil according to an embodiment of the invention.
Figure 1B:
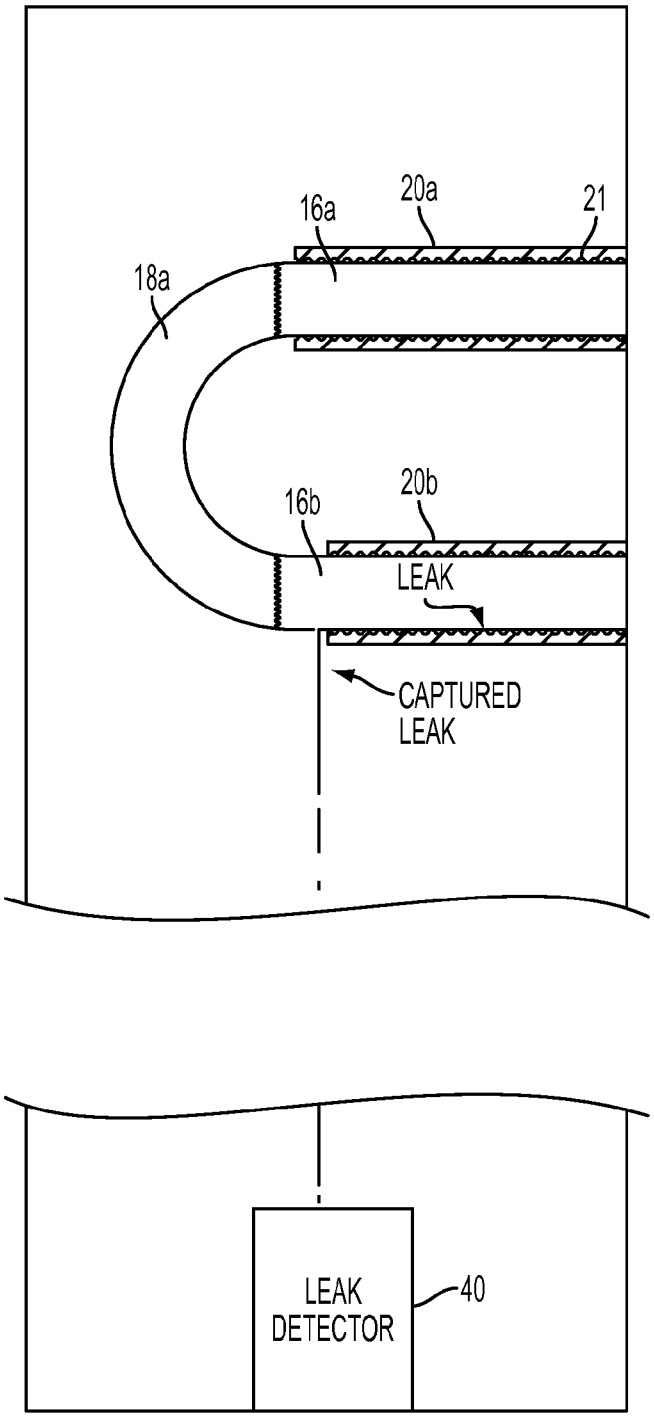
FIG. 1B is a representation of the principles of the invention, accomplished with double-walled/double tubed straight tubes connected by single-walled/single tubed return bends.

FIG. 1A shows a heat exchange coil 10 according to an embodiment of the invention. Heat exchange coil 10 receives fluid from header 12 through connecting tube 14. Connecting tube 14 is connected to inner tube 16*a*. Fluid travels through the heat exchange coil through inner tubes 16*a*, 16*b*, and 16*c*, via return bends 18*a* and 18*b* Inner tubes 16*a*, 16*b*, and 16*c* are expanded into outer tubes 20*a*, 20*b*, and 20*c*, respectively. According to an embodiment of the invention, the inner surfaces of outer tubes 20*a*, 20*b*, and 20*c* have dimples, ribs, or other surface features 21 to create both contact between and voids between the inner and outer tubes to allow the passage of fluid between them (see FIG. 1B). According to an alternative embodiment, the outer surface of the inner tubes may have spacing features or be fitted with spacing devices to accomplish the same purpose. Fins 22 are fixed to the outside surfaces of the outer tubes to enhance heat exchange. The air flow is directed only over the center portion 24 of the coil. Return bends 18*a*, 18*b*, and the ends 26 of outer tubes 20*a*, 20*b* and 20*c* are located outside the air flow path.

According to one method of manufacturing a coil according to the invention, outer tubes are inserted into the fin matrix and expanded into the fins. The inner tubes are then inserted into the outer tubes and expanded to provide contact at the contact surfaces and voids at non-contact locations. The return bends may then be brazed to the inner tubes.

If a leak occurs in any of inner tubes 16*a*, 16*b*, or 16*c*, it will be captured in corresponding outer tube 20*a*, 20*b*, or 20*c*, travel down the length of the tube in which it was captured by virtue of the voids created between the tubes by the inner surface features 21 of outer tubes 20*a*, 20*b* and 20*c*, then fall out of the end of the outer tube under force of gravity into a drip pan/drain pan 28 in return bend box 30*a*, 30*b* (FIG. 2), outside of the air flow path. In this way, the air flow path (and hence the transformer, or any other device into which the air is ultimately directed) is protected from water contamination resulting from leaks in the heat exchange coil, and leaks are quickly and easily detected, all without complicated nested and sealed chambered header arrangements. Alternatively, the space between the outer tubes and the inner tubes at one end of the coil may be brazed or otherwise sealed shut. According to this embodiment, water from leaks in the inner tubes falls out of the outer tubes only in the return bend box at the end of the coil that is opposite the end where the space between the inner and outer tubes is sealed shut.

Figure 2A:
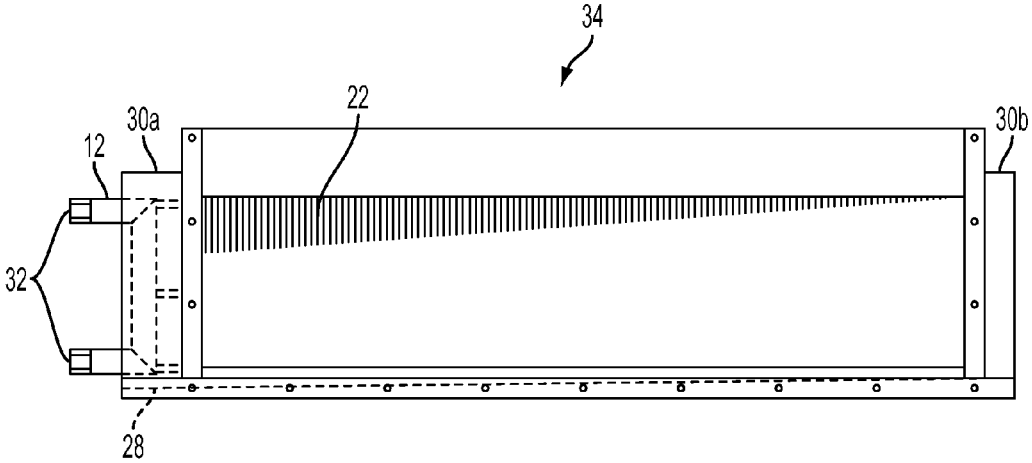
FIG. 2A is a front view schematic of a heat exchanger including a heat exchange coil according to an embodiment of the invention.
Figure 2B:
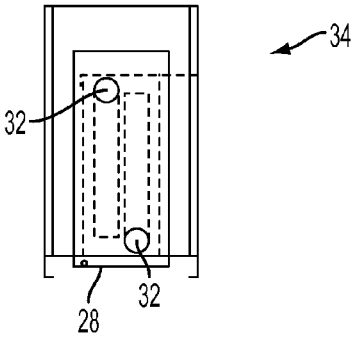
FIG. 2B is a side view schematic of the heat exchanger shown in FIG. 2A.

FIGS. 2A and 2B show schematics of a heat exchange unit 34 including a heat exchange coil according of the invention. Return bend boxes 30*a* and 30*b* are situated outside of the primary housing of heat exchange unit, and contain the return bends (not shown) at both ends of the inner tubes (also not shown). Fins 22 are shown, which as described above, are fixed to the outside surfaces of the outer tubes of the heat exchange coil. Header 12 includes fluid inlet/outlets 32. According to an embodiment of the invention, drain pan 28 may be provided with a slope between the return bend boxes so that water from leaks collected in one return bend box is made to travel to the other side of the coil where it can be detected with a leak detector. Alternatively, according to an embodiment of the invention where the spaces between the inner tubes and outer tubes are closed, no sloped drain pan between the return bend boxes is required, as water from any leaks will fall only into the return bend box at the end of the coil opposite the end where the spaces between the inner and outer tubes are sealed shut.

Figure 3:
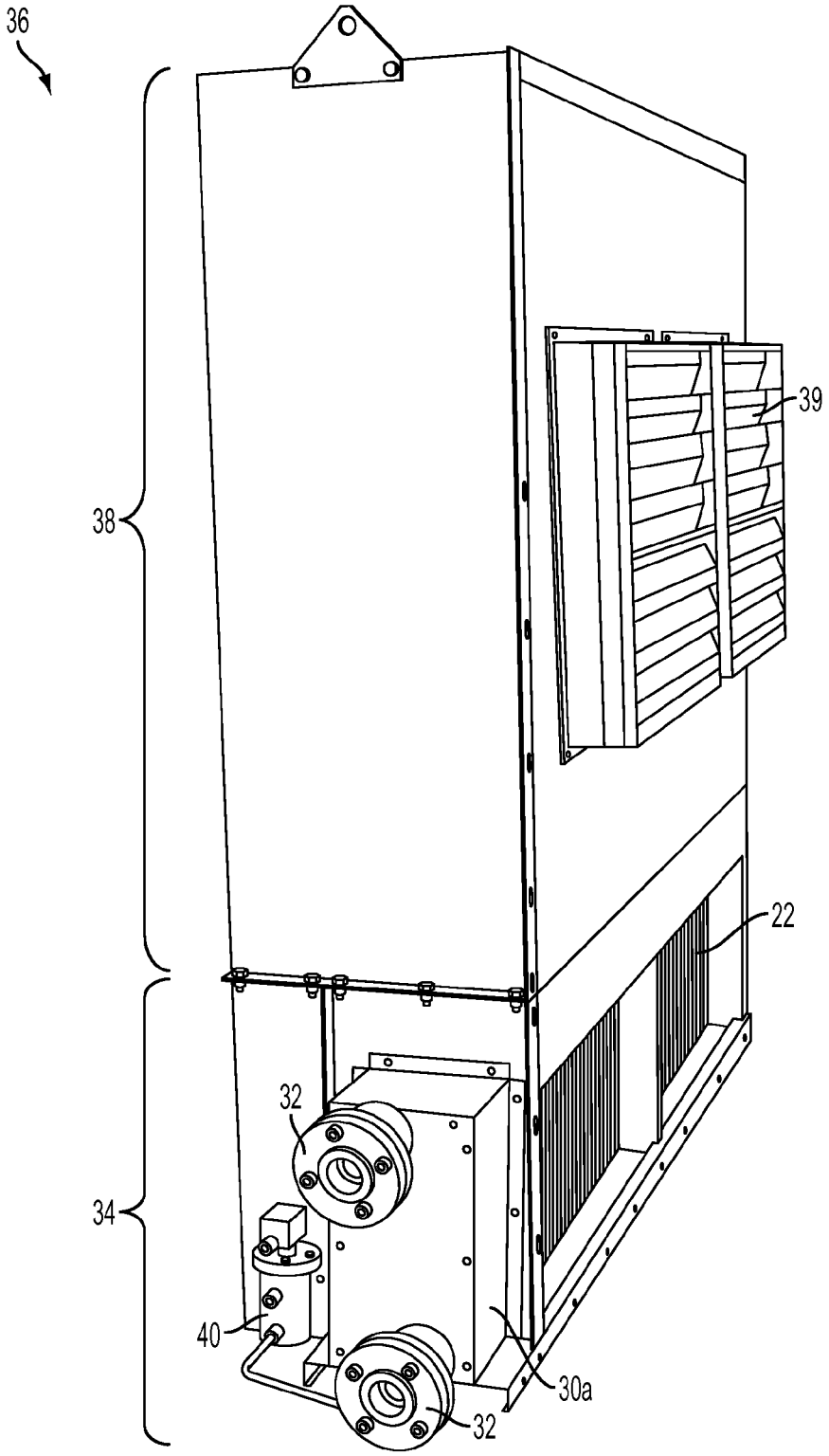
FIG. 3 is a front perspective drawing of a transformer air cooling unit, including a heat exchanger according to an embodiment of the invention.
Figure 4:
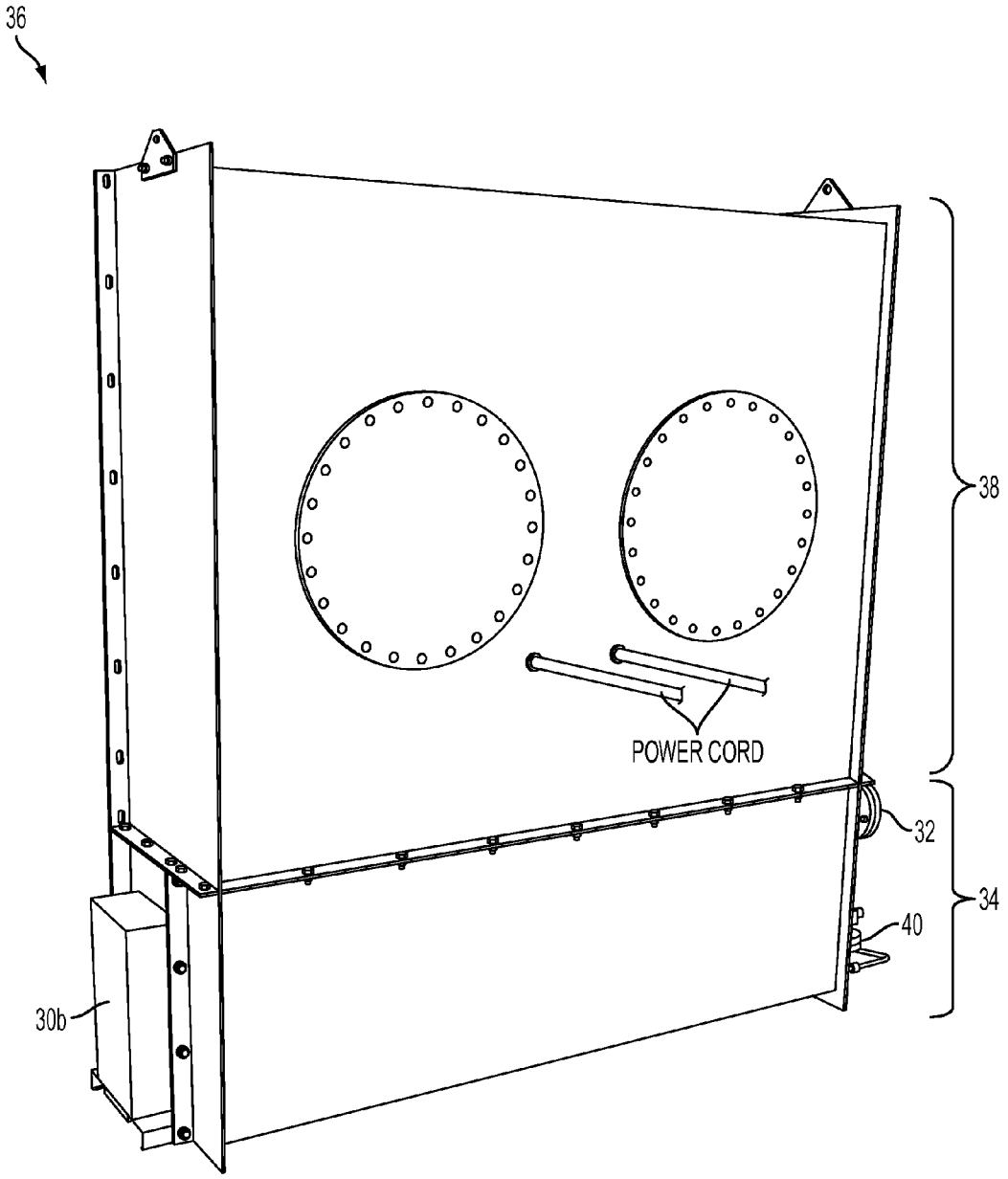
FIG. 4 is a rear perspective drawing of a transformer air cooling unit shown in FIG. 3.
Figure 5:
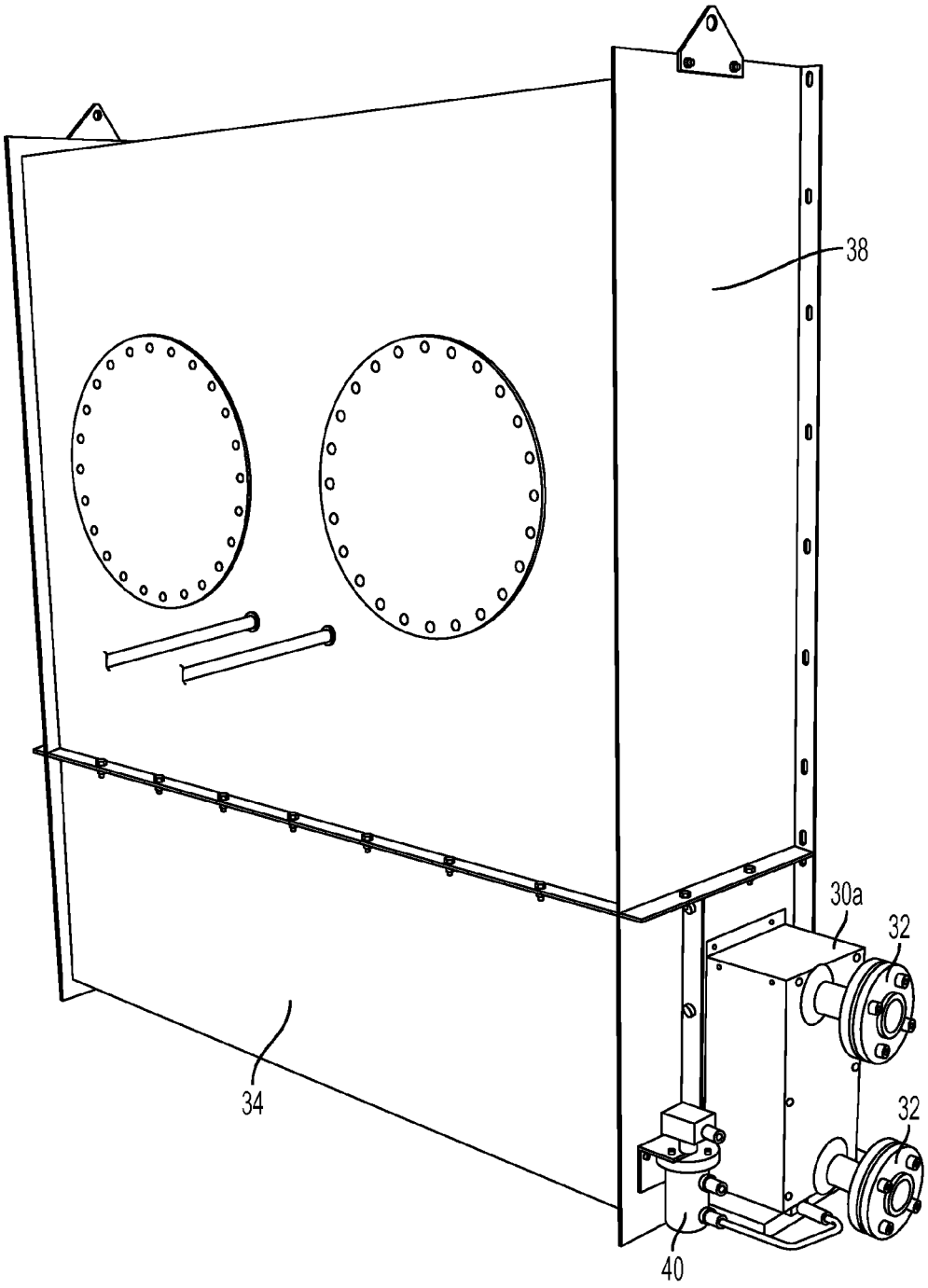
FIG. 5 is another rear perspective drawing of the transformer air cooling unit shown in FIG. 3.

FIGS. 3-5 show different views of a transformer air cooling unit 36, including a heat exchanger according to an embodiment of the invention. Transformer air cooling unit 36, includes fan box 38, resting on top of heat exchange unit 34. Fans inside fan box 38 pull air from a transformer transfer unit (not shown) through louvers 39 and direct air down through heat exchange unit 34. Air passes over the tubes (not visible in FIGS. 3-5) and fins 22, to exit the bottom of the unit. Return bends and the ends of outer safety tubes are contained in return bend boxes 30*a* and 30*b*, outside of the air flow path, and the air flow path is preferably contained within heat exchange unit 34. Water enters one of fluid inlet/outlets 32 and exits through the other according to desired water flow valving/settings. Leak detector 40 detects the presence of water in the bottom of return bend box 30*a*.

The arrangement shown in FIGS. 3-5 should not be considered to limit the invention, and given the present disclosure, persons of ordinary skill would readily appreciate that the features of the invention described herein may be used according to any number of heat exchange applications and arrangements. The heat exchange coil of the invention can be used according to any number of arrangements where air passing over the coil must be protected from fluid contained in the coils, provided that return bends and the ends of the outer "safety" tubes are located outside of the air flow path.

The invention claimed is:

1. An air-cooled transformer cooling system, comprising:

an air moving system for receiving heated air from an air cooled transformer and moving said heated air over a heat exchange coil in an air flow path, a heat exchange coil, comprising:

exactly two sets of concentric nested tubes extending across said air flow path in a direction perpendicular to a direction of said air flow path, wherein said exactly two sets of concentric nested tubes comprising a set of inner tubes and a set of outer tubes;

each said inner tube extends across an entirety of said air flow path and is connected to an adjacent inner tube by one or more return bend tubes to define a fluid path through said heat exchange coil containing water for cooling said heated air passing over said heat exchange coil; and each said outer tube extends across an entirety of said air flow path and terminates outside of said air flow path.

2. A transformer cooling system according to claim 1, further comprising surface features on inner surfaces of said outer tubes to create contact points and voids between said inner tubes and outer tubes.

3. A transformer cooling system according to claim 1, further comprising fins fixed to said outer tubes to increase heat exchange capacity of said heat exchange coil.

4. A transformer cooling system according to claim 1, further comprising return bend boxes configured to house said return bend tubes and ends of said outer tubes.

5. A transformer cooling system according to claim 4, further comprising a drip pan situated to collect water dripping from one or more ends of said outer tubes.

6. A transformer cooling system according to claim 4, further comprising a leak detector to detect the presence of water in said drip pan.

7. A transformer cooling system according to claim 1, wherein ends of said outer tubes at one side of said coil are sealed to outer surfaces of corresponding inner tubes so that water from leaks in said inner tubes escapes said outer tubes only at another side of said coil.

* * * * *